US006332226B1

(12) United States Patent
Rush, III

(10) Patent No.: US 6,332,226 B1
(45) Date of Patent: Dec. 25, 2001

(54) IMPACT INDICATOR FOR ATHLETIC HELMETS

(76) Inventor: Gus A. Rush, III, 1800-12th St., Meridian, MS (US) 39301

( * ) Notice: Subject to any disclaimer, the term of this patent is extended or adjusted under 35 U.S.C. 154(b) by 0 days.

(21) Appl. No.: 09/575,378

(22) Filed: May 22, 2000

Related U.S. Application Data

(63) Continuation of application No. 09/179,319, filed on Oct. 27, 1998, now Pat. No. 6,065,158.
(60) Provisional application No. 60/063,459, filed on Oct. 29, 1997.

(51) Int. Cl.[7] ..... A42B 3/00
(52) U.S. Cl. ..... 2/412
(58) Field of Search ..... 2/411, 412, 413, 2/414, 410, 425, 422, 455

(56) References Cited

U.S. PATENT DOCUMENTS 3,616,463 * 11/1971 Theodore .
3,946,441 * 3/1976 Johnson .
4,064,565 * 12/1977 Griffiths .
4,663,785 * 5/1987 Comparetto .
5,343,569 9/1994 Asare et al. .

FOREIGN PATENT DOCUMENTS

2566632 * 1/1986 (FR) .

* cited by examiner

*Primary Examiner*—Rodney M. Lindsey
(74) *Attorney, Agent, or Firm*—Pillsbury Winthrop LLP

(57) ABSTRACT

A helmet includes an outer shell and an inner liner. The inner liner includes a visual indicator to indicate when the helmet has experienced an impact of sufficient force to permanently deform a portion of the inner liner. The visual indicator thus indicates when the helmet no longer offers it's peak level of protection to the wearer and should be repaired or replaced.

7 Claims, 2 Drawing Sheets

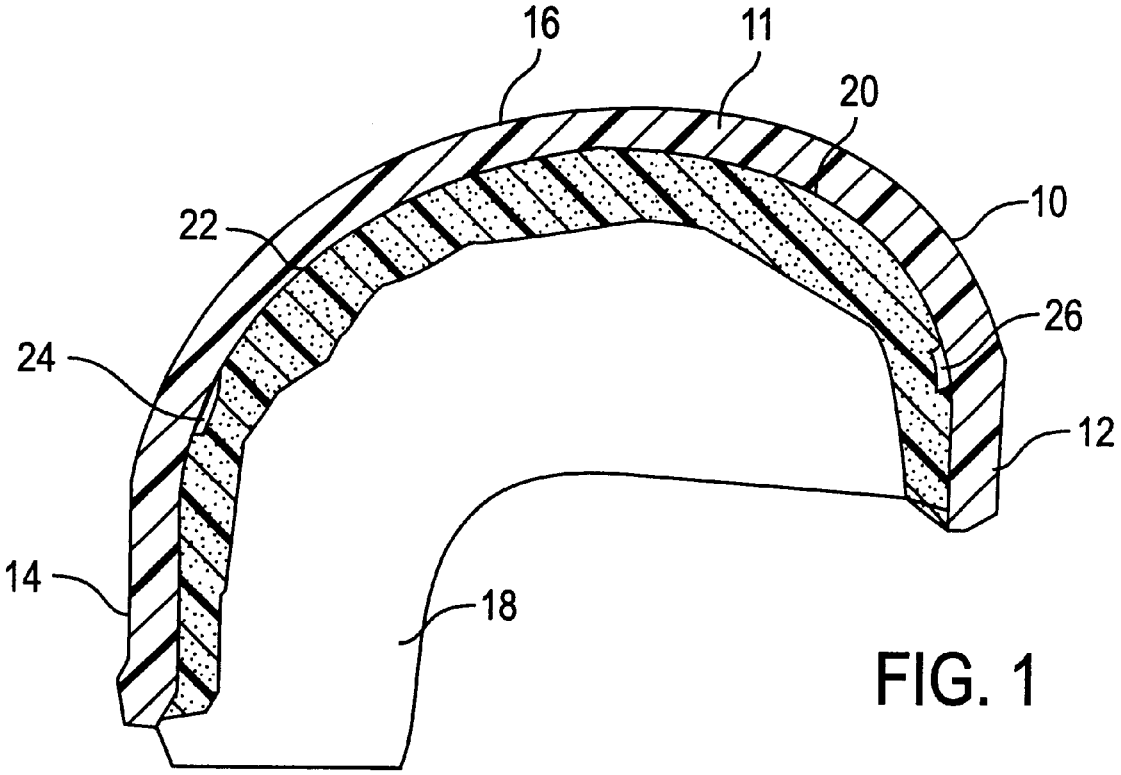
FIG. 1
FIG. 2
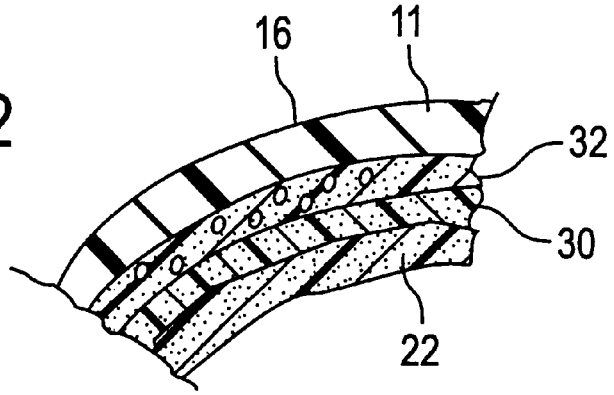

IMPACT INDICATOR FOR ATHLETIC HELMETS

This is a continuation of application No. 09/179,319, filed Oct. 27, 1998 now U.S. Pat. No. 6,065,158.

This application claims the benefit of Provisional Application No. 60/063,459, filed Oct. 29, 1997.

FIELD OF THE INVENTION

This invention relates to helmets of the type used in athletic contests where the participants typically wear the helmets for protection. The present invention provides for a liner having an impact absorption capability, but which also includes an impact indicator so that a supervisor or the user will be able to determine by inspection of the liner after an impact the character of the impact in terms of its magnitude as well as the location of the impact should it result in injury to the head of the wearer.

BACKGROUND OF THE INVENTION

In many athletic contests, rough and sometimes dangerous encounters occur particularly among school children such as in football, soccer, and other sports and these have frequently led to injury to the head or spinal column of the user which can result in life long disability and even death. As a consequence, there has been a need for improvements in athletic helmets and a number have become available such as is disclosed in my prior U.S. Pat. Nos. 5,390,367, 5,621,922, 5,539,935, 5,546,609, 5,287,562, and Ser. No. 08/685,840. While these improvements have provided supervisory personnel the ability to monitor unnecessary or dangerous activities during athletic contests or even to prevent injury, the installation of such equipment as well as devices provided by others have not been widely accepted due primarily to the expense and the reluctance of officials to seek funding in already reduced school budgets.

The need for improved safety in such contests has become paramount with the increasingly large damage awards to victims, who are often students, who have suffered injury during athletic contests supervised by school officials. In professional sports, it is well known that a number of prime athletes have had their careers shortened or their playing time diminished as a result of head injuries which are not accommodated by the present athletic helmet design.

SUMMARY OF THE INVENTION

The present invention overcomes a number of the foregoing shortcomings by providing a relatively inexpensive yet superior safety device in the form of a removable liner for a conventional helmet thus avoiding a major expense in redesigning a piece of equipment that is in widespread use. In a preferred embodiment, the invention provides a compressible liner which will have a required low degree of compressibility or resistance to crushing to provide enhanced safety for the wearer of the liner in a conventional athletic helmet such as a football helmet. In addition, the liner is sufficiently flexible and formable to be easily installed from a supply in any size helmet. Further, the material is preferably expanded polystyrene foam where the foam has been expanded with a nontoxic, colored gas. With this arrangement, when an impact on the head of the wearer is experienced, the gas filled cells will burst and leave a color indicator about the site of the impact. A supervisor will then be able to determine whether unnecessary roughness has been employed in the contest or the event and thus be able to take remedial action and additional training for the individual involved. In another embodiment, a multi-layer lining system is employed to assure safety and compression of one or more of the layers only upon receiving an impact above a selected threshold. When so deformed, the affected layer or layers can be removed and easily replaced.

BRIEF DESCRIPTION OF THE DRAWINGS

FIG. 1 illustrates in sectional view a conventional helmet in which has been installed a liner of the present invention;

FIG. 2 illustrates in section a further multi-layer form of the invention;

DETAILED DESCRIPTION OF THE INVENTION

Figure 3:
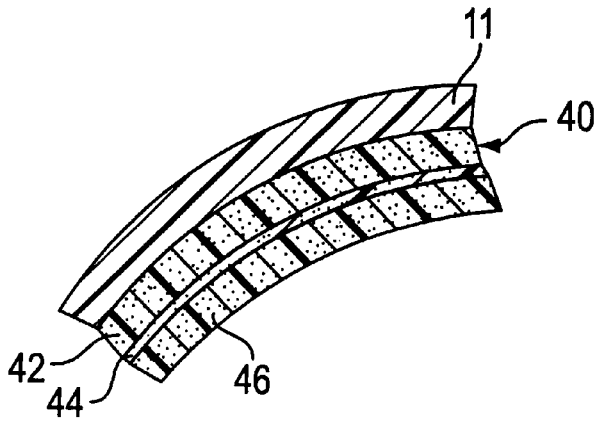
FIG. 3 illustrates in sectional view an alternative embodiment of the invention.

Referring to the drawings, there is shown schematically in FIG. 1 a sectional view of a conventional football helmet 10 which is typically made of polycarbonate material having the required density and resistance to bending conventionally used in these types of helmets. The helmet has an outer shell 11 having a front portion 12 and a depending rear portion 14 extending down from the crown 16. In the usual helmet, the side portions such as is illustrated at 18 will cover the ears of the wearer.

According to the present invention, a liner of compressible gas expanded foam material such as polystyrene 20 is inserted to cover substantially all of the interior surface 22 of the shell 11. The liner 20 may be held in place by localized adhesive bonded sites such as at 24 and 26. In some applications, Velcro-type attachments may be used. The liner 20 should have sufficient resistance to compression to prevent the interior surface 22 of the helmet being contacted by the head of the wearer in the event of most impacts. Also, the polystyrene should be foamed with a non-toxic colored gas so that when a localized compression takes place, the cells of the foam will burst and leave a colored marker to indicate the general area of the site of the impact.

Such impacts will be useful to a supervisor or medical personnel in the event the wearer is unconscious after a blow to the head. Frequently, in athletic sports such as football, a participant will use his head as a ram and this can be a source of severe medical injury. In such an event, usually the crown area will be contacted and the liner compressed in that area and inspection of the liner will immediately reveal this to the physician.

In FIG. 2 there is shown a further version of the invention where a multi-layer liner including layers 22, 30 and 32 are provided superimposed on one another in the shell 11. Layer 22 will comprise the same material as described above in connection with FIG. 1. Layer 30 or 32 may usefully comprise a highly absorbent layer of compressible material such as polyurethane foam cushion which after an impact will slowly return to its undeformed condition. The other of the two layers, 30 or 32 may comprise gas filled cells. The density of this layer relative to the layer 22 may be varied to accommodate the nature of the play to be engaged in.

In use, the usual impacts of a sport will only cause small, local deformations of the outer layer, 30 or 32 without causing rupture of layer 22. However, in the event of a severe impact that causes collapse of all layers and rupture of the cells of layer 22, the liner can be removed and replaced for continued use.

Alternatively, the positioning of layers 22 with respect to layers 30 and 32 may be reversed with layer 22 position to the interior of the helmet.

Figure 4:
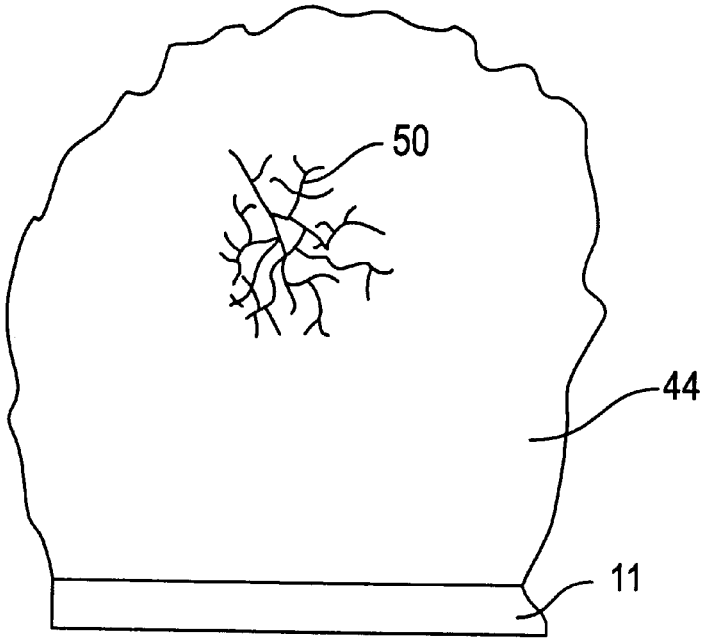
FIG. 4 illustrates in plan view the alternative embodiment of FIG. 3.

In an alternative embodiment as shown in FIG. 3, an inner liner 40 is provided in an outer shell 11. The inner liner 40 includes a first layer 42 constructed of a material, such as polystyrene, that permanently deforms upon encountering an impact of sufficient force. A thin surface indicator layer 44 is applied to the interior surface of the liner 42. This indicator layer provides a readily ascertainable visual indication when the helmet has been subjected to an impact of a predetermined sufficient force such as to permanently deform the first layer 42. The layer 44 can be in the form of a relatively hard, brittle material that will exhibit cracking if the underlying liner layer 42 is deformed sufficiently. As shown in FIG. 4, (with layer 46, discussed below, removed), the surface of layer 44 can be seen to exhibit cracking 50 in an area subjected to a high impact. The force upon which cracking of the layer 44 occurs can be varied by varying the thickness of the layer and the type of the layer material.

Alternatively, the layer 44 can be in the form of a layer of applied microcells containing a dye or colorant that will exhibit a visual color change when the microcells are ruptured upon sufficient impact level and the dye or colorant is exposed to oxygen. Such types of dye-containing microcell coatings are commonly utilized in "carbonless" multipage forms. For instance, the coating is applied to the backs of the pages, and the force of writing on the top page bursts the microcells underneath, thereby depositing the dye on the page below which then exhibits color upon exposure to oxygen.

An additional liner layer 46 is positioned over the layers 42 and 44 and is constructed of an elastically compressible material that will generally return to its shape after impact and not exhibit substantial permanent deformation. Such a material would include polyurethane foam. This layer 46 will absorb the force from normal impacts while the layer 42 does not deform until impacts above a predetermined level are reached. Thus, this layer 46 helps protect the indicator layer 44 and prevent triggering of the visible indicator effect until the impact rises above the predetermined level. This layer, because of its elastic compressibility, also improves the conformability of the helmet to the wearer's head, thereby improving comfort to the wearer. Additional elastically compressible layers can be placed over the layer 46 and have different densities and compressibility factors to tailor the overall impact/compressibility characteristics of the helmet. Additional permanently deformable layers may be used between the layer 42 and shell 11 with different densities and compressibility factors for the same effect.

Alternatively, the indicator layer 44 can comprise one or more rigid housings containing one or more dye or colorant containing cavities that will rupture upon sufficient impact, leaving the visible color indicator.

With respect to all of the embodiments disclosed herein, the liners can be segmented so that only the damaged segment need be replaced. Furthermore, each of the embodiments disclosed herein can utilize a surface layer over the compressible layers of Goretex, or other similar material, to repel water from the compressible layers but allow dissipation of accumulated moisture.

It should be noted that the liner of this invention can readily be employed with a full face guard type helmet as is disclosed in my earlier U.S. Pat. No. 5,287,562 the disclosure of which is incorporated herein by reference.

While this invention has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the invention following, in general, the principles of the invention and including such departures from the present disclosure as come within known or customary practice in the art to which the invention pertains, and as may be applied to the essential features hereinbefore set forth and followed in the spirit and scope of the appended claims.

I claim:

1. A helmet, comprising:

an outer shell; and an inner liner attached to an interior of the outer shell, the inner liner including a first layer of compressible material that will permanently deform upon encountering an impact to the helmet above a first predetermined force, a second indicator layer positioned on a side of the first layer away from the outer shell, and a third layer of elastically compressible material that will substantially return to an undeformed condition after an impact results in deformation of the layer, the third layer removably positioned on a side of the second indicator layer away from the outer shell, wherein the second indicator layer will permanently deform upon permanent deformation of the first layer to leave a readily ascertainable visual indication when the helmet has been subjected to an impact above the first predetermined force.

2. A helmet as in claim 1, wherein the second indicator layer comprises a thin layer of a relatively brittle material that will permanently deform by exhibiting cracking as the readily ascertainable visual indication of when the helmet has been subjected to an impact above the first predetermined force.

3. A helmet as in claim 2, wherein an extent of the cracking of the second indicator layer can be varied by altering at least one of the thickness and the type of the relatively brittle material.

4. A helmet as in claim 3, wherein the inner liner is replaceable.

5. A helmet as in claim 1, wherein the second indicator layer comprises a layer of colorant containing microcells that will permanently deform by rupturing to release the colorant as the readily ascertainable visual indication of when the helmet has been subjected to an impact above the first predetermined force.

6. A helmet as in claim 5, wherein the inner liner is replaceable.

7. A helmet as in claim 1, wherein the inner liner is replaceable.

* * * * *